United States Patent [19]

van de Vorle

[11] Patent Number: 4,471,043

[45] Date of Patent: Sep. 11, 1984

[54] DIAZOTYPE MATERIAL

[75] Inventor: Wilhelmus J. M. van de Vorle, Venlo, Netherlands

[73] Assignee: Océ-Nederland B.V., Venlo, Netherlands

[21] Appl. No.: 442,764

[22] Filed: Nov. 18, 1982

[30] Foreign Application Priority Data

Nov. 23, 1981 [BR] Brazil ..... 8107605

[51] Int. Cl.[3] ..... G03C 1/60

[52] U.S. Cl. ..... 430/159; 430/149; 430/150; 430/158; 430/160; 430/162; 430/176; 430/177

[58] Field of Search ..... 430/176, 162, 160, 159, 430/158, 149, 177, 150

[56] References Cited

U.S. PATENT DOCUMENTS

| | | | |
|---|---|---|---|
| 2,805,159 | 9/1957 | Unkauf | 430/159 |
| 2,822,272 | 2/1958 | Kosalek et al. | 430/176 |
| 3,159,487 | 12/1964 | Krieger et al. | 430/159 |
| 3,301,679 | 1/1967 | Halperin et al. | 430/176 |
| 4,043,816 | 8/1977 | Bomers et al. | 430/149 |
| 4,275,137 | 6/1981 | Verhoof | 430/176 |

FOREIGN PATENT DOCUMENTS

| | | | |
|---|---|---|---|
| 972951 | 2/1963 | United Kingdom . | |
| 1072122 | 6/1967 | United Kingdom | 430/159 |

OTHER PUBLICATIONS

Muller, P., "Precoating of Diazotype Paper", *Tappi*, vol. 48, No. 6, 8/1965.

*Primary Examiner*—Charles L. Bowers

*Attorney, Agent, or Firm*—Albert C. Johnston

[57] ABSTRACT

Diazotype material having enhanced water-wet properties and especially suitable when imaged for being drawn or written upon, and for use as an intermediate original, is made of a support such as a transparent polymeric film carrying on one of its sides a light sensitive diazo layer formed of a dispersion of a light sensitive diazonium compound and a large amount of amorphous hydrated silica particles having a bound water content of at least 50% by weight in a polymeric binder consisting essentially of a 20 to 45% hydrolyzed polyvinyl acetate which preferably is a product of partial hydrolysis of a PVAC having in ethyl acetate at 20° C. a Heoppler viscosity of 100 to 800 mPa.s. The weight ratio of the hydrated silica to the partially hydrated PVAC in the layer typically is in the range of 2:3 to 3:2. The support advantageously carries on its other side a light-pervious drafting layer formed of a dispersion of a silica filler in a partially hydrolyzed PVAC the same as that required for the diazo layer. Adherence of the specified layers and drafting properties of the material can be enhanced by coating on each side of the film, before applying those layers, a subbing layer formed of polymeric material, e.g. a mixture of a vinylidene chloride-acrylonitrile copolymer and a methylated melamine-formaldehyde resin, that is adherent to the film surface and contains a silica pigment which preferably is the same as that of the drafting layer. An advantageous one component diazotype material is obtained by incorporating a suitable diazonium salt in the diazo layer in the absence of an azo coupling agent, while such a two component diazotype material is obtained by making that layer to contain an azo coupling agent with a suitable diazonium salt.

20 Claims, 1 Drawing Figure

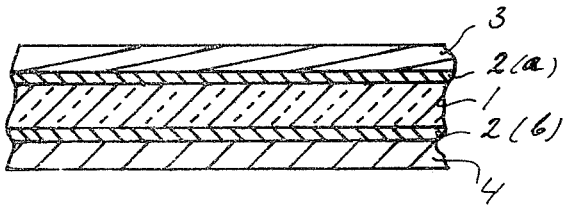
3
2(a)
1
2(b)
4

DIAZOTYPE MATERIAL

This invention relates to a new diazotype material.

Diazotype materials generally comprise a support carrying a light sensitive layer containing a light sensitive diazonium compound. When such materials are exposed to a light image, especially of ultra violet light, the diazonium compound is decomposed in the portions of the layer struck by the light and the undecomposed diazonium compound may subsequently be converted into an azo dye, thereby providing a recorded image in a diazo copy. The conversion to the azo dye is effected by reaction with a coupler, or so-called azo coupling agent, which may be a phenolic or active methylene compound. The coupler may be employed in a number of ways:

(1) by incorporating it into the diazotype coating and developing it by treatment with an alkali;
(2) by including an alkali as well as the coupler in the diazotype coating but inhibiting the alkali and thermally activating it to effect coupling;
(3) or by treating the exposed diazotype material with a developing solution containing the coupler.

In the first two cases both active ingredients, i.e. the diazonium compound and the coupling agent, are present in the light sensitive layer; so materials containing such a layer are called two component diazotype materials. When only one active ingredient is present in the layer, as in the third case, the materials are called one component diazotype materials.

Diazotype materials generally are made by applying to a support a solution of a diazonium compound which usually contains other materials such as a polymeric binder. When the support is a film of a plastics or polymeric material intermediate anchoring or subbing layers may be applied to the film surface. When the support is light-pervious, as by being translucent, the diazo copies are suitable for use as so-called intermediate originals for making further copies by contact photoprinting.

The light sensitive layer of diazotype materials of the third type mentioned must meet a number of requirements, some of which are incompatible with each other. For instance, on the one hand the layer must have good hydrophilic properties in order to absorb readily the aqueous developing solution; on the other hand the layer must be sufficiently hydrophobic so that it is not deteriorated by the aqueous developing solution and thus shows a good wet-rub-resistance immediately after development and does not become tacky. Further, the layer must show good adhesion to the support or underlying anchoring layer, both of which generally have a hydrophobic character.

A diazotype material is known, as disclosed in Example V of British Pat. No. 972,951, in which the light sensitive layer comprises a partially hydrolyzed polyvinyl acetate as a film forming binder and the support preferably is translucent. This known material, however, has some serious drawbacks. Among them is that its light sensitive layer is slightly deteriorated by the aqueous developing solution, resulting in a tacky copy having an insufficient wet-rub-resistance. Consequently, fresh copies are easily damaged, even if only a slight pressure is exerted on the image layer. Another shortcoming is that although the material may be used as an intermediate original, its structure does not make it suitable for drafting and/or writing on the copies. As drafting and writing properties would greatly enhance the usefulness of such material as an intermediate original, for instance in the drawing offices of architects, building contractors, ship builders, mechanical engineers and car makers, there has been a long need for such material having such desirable properties.

It is therefore a principal object of the present invention to provide a one component diazotype material that is excellently developable by an aqueous developing solution without deterioration of its light sensitive layer by the solution.

Another object of the invention is to provide a light-pervious diazotype material that has drafting and writing properties and whereby, moreover, a drawing or writing made on the material can easily be corrected by chemical erasure of the error and replacing it by the correct drawing or writing.

These objects can be achieved, according to the present invention, by the provision of a diazotype material comprising a support carrying a light sensitive diazo layer formed of a dispersion of light sensitive diazonium compound in a polymeric binder consisting essentially of a partition hydrolyzed polyvinyl acetate having a degree of hydrolysis between 20 and 45%, which dispersion also contains in an amount sufficient to enhance the water-wet properties of said layer amorphous hydrated silica particles, i.e., an amorphous synthetic silica pigment, having a bound water content of at least 50% by weight. The partially hydrolyzed polyvinyl acetate to be used typically is a product of partial hydrolysis of a starting polyvinyl acetate having in ethyl acetate at 20° C. a Hoeppler viscosity in the range of 25 to 2,000 mPa.s.

The diazotype material according to the invention may be a one component or a two component diazotype material. The one component diazotype material develops readily when an aqueous developing solution is spread over its light-sensitive surface, and the image-bearing layer is not tacky and shows a good wet-rub resistance even immediately after development. The two component diazotype material develops readily upon exposure to an alkaline vapor, such as ammonia vapor.

The combination in the light sensitive layer of the specified partially hydrolyzed polyvinyl acetate with the specified silica pigment has been found to enable obtention of a desired balance between the hydrophilic and the hydrophobic properties of the diazo layer, so that this layer will exhibit desired rub resistance when wet with water or an aqueous liquid for developing or otherwise processing it yet is also quickly receptive to such liquid in the case of a one component diazo layer. The amorphous hydrated silica pigment additionally gives the light sensitive layer writing and drafting properties, enabling it to be drawn or written upon easily and erasably, which is of importance for two component diazo layers as well as for one component layers.

The partially hydrolyzed polyvinyl acetate to be used according to the invention preferably is prepared from a starting polyvinyl acetate (PVAC) having a Hoeppler viscosity of between 100 and 800 mPa.s, and the PVAC preferably is hydrolyzed to a degree of 30 to 40% before being used. The partially hydrolyzed PVAC may, however, be prepared by any other known method; for instance, it may be prepared by partially hydrolyzing a PVAC or by esterifying a polyvinyl alcohol to the desired degree. The values of the Hoeppler viscosity of the starting PVAC are determined according to standard specifications such as those identified as DIN 53015.

Examples of PVACs that possesses the required viscosity are the polyvinyl acetates sold under the trade identifications Mowilith 30,40,50,60 and 70 (by Hoechst AG), Vinnapas UW 1, 4 and 10 (by Wacker-Chemie GmbH), and Vinavil K 60 and 70 (by Montedison S.p.A.). Of these examples, Mowilith 50 and 60, Vinnapas UW 4 and 10 and Vinavil K 60 and 70 are preferred.

The amorphous hydrated silica that confers enhanced water-wet properties, including better water acceptance, in the light sensitive layer, thus improving inter alia the developability of a one component diazo layer by an aqueous developing solution, is an amorphous synthetic silica pigment having a large content of bound water. The bound water content typically is above 50%, and preferably is in the range of between 60 and 70% of the weight of the pigment. An example of such a pigment is the silica containing about 65% of water which is sold under the trade identification Gasil WP2 (by Joseph Crosfield & Sons, Ltd.). The particles of the amorphous hydrated silica have sizes smaller than 30 μm and generally are of the order of about 12 μm in average size.

The amount of the hydrated silica to be used in the light sensitive layer preferably is in the weight ratio of from 2:3 to 3:2 to the amount of partially hydrolyzed polyvinyl acetate present, so is in the range of from 40% to 60% of the combined weight of hydrated silica particles and partially hydrolyzed PVAC in the layer. Notwithstanding the relatively great amount of the pigment present, the light sensitive layer still remains pervious to actinic light, which makes it especially suitable for a diazotype material to be used as an intermediate original when imaged.

The support of the diazotype material may be made of any suitable material known in the art. It is advantageous, however, to use a light-pervious or transparent support material. For example, the support may be tracing paper that may or may not be lacquered, a tracing linen, or any suitable polymeric film material such as a film composed of a cellulose ester, e.g. cellulose acetate, or of polystyrene, a polyester of dibasic aromatic carboxylic acid with divalent alcohol, e.g. polyethylene terephthalate, a polyamide, a polymer or copolymer of vinyl chloride, a polycarbonate or a polymer or copolymer of an olefine, e.g. polypropylene. Support films made from these polymeric materials may be produced by known processes. In particular, films of some of these materials may be made by stretching the films in one or more directions to impart molecular orientation, followed by heat setting to prevent the stretched films from shrinking if they may be subjected to high temperatures.

Such a stretching and heat setting process may be used for the production of biaxially oriented and heat set films of polyethylene terephthalate. The preferred films for use according to this invention are films of cellulose acetate and biaxially oriented and heat set films of polyethylene terephthalate.

In an advantageous embodiment of the invention a transparent support is coated with a light sensitive diazo layer according to the invention and a drafting layer is also applied at the back side of the support, opposite to the side carrying the light sensitive layer. This drafting layer may be any conventional layer known as such but preferably it is pervious to actinic light so that, after the material has been provided with an image, the finished copying material can be used as an intermediate original. Examples of suitable drafting layers are described in British Pat. No. 1,072,122.

In the case of such a drafting layer applied at the back side of a one component diazotype material according to the invention, which material when developed is wetted not only on the upper, light sensitive side but also at the back side over the drafting layer, the drafting layer should be made to provide a balance of hydrophilic and hydrophobic properties similar to that provided in the light sensitive diazo layer. To this end, according to a further feature of the invention, the drafting layer is formed by use of a polymeric binder consisting essentially of a partially hydrolyzed polyvinyl acetate substantially the same as that employed in the light sensitive layer. Further, the pigment dispersed in the binder of the drafting layer advantageously is a finely divided silica, which may be of the same type as is used in the light sensitive diazo layer, but which preferably is a crystalline silica well-known for such use, because the latter product imparts better toothing properties to the layer. The particle size of the crystalline silica is smaller than 20 μm and generally is of the order of about 5 μm.

The light sensitive diazonium compound to be used in the light-sensitive layer can be selected from among the many diazo compounds known to be suitable for diazotype materials, including compounds as disclosed in British Pat. Nos. 1,045,242, 1,064,128 and 1,064,129. Especially desirable for use in the one component diazotype material of this invention are diazonium salts of amines of the general formula

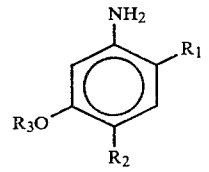

wherein $R_1$=an O-alkyl group or a

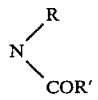

group in which R is an alkyl, aralkyl or cycloalkyl group, R' an alkyl, aralkyl, cycloalkyl or O-alkyl group, or in which R and R' are the number of $CH_2$ groups necessary to form an N-heterocyclic saturated 5- or 6-membered ring;

$R_2$=a phenyl group which may be substituted, or a S—R'' group or a

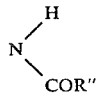

group in which R'' is an alkyl group or phenyl group which may be substituted; and $R_3$=an alkyl, aralkyl or cycloalkyl group.

Specific examples of suited diazonium compounds are:

3-chloro-4-(methyl)(cyclohexyl)amino-benzene diazonium. ½ $ZnCl_4$;
2,5-dichloro-4-(methyl)(cyclohexyl)amino-benzene diazonium. ½ $ZnCl_4$;
2,5-diethoxy-4-benzoylamino-benzene diazonium. ½ $ZnCl_4$;
2,5-dibutoxy-4-benzoylamino-benzene diazonium. ½ $ZnCl_4$;
2-(ethoxycarbonyl)(methyl)amino-4-benzoylamino-5-methoxy-benzene diazonium. ½ $ZnCl_4$;
2-chloro-4-dimethylamino-5-(4'-chlorophenoxy)-benzene diazonium. ½ $ZnCl_4$;
2,5-dibutoxyl-4-(4'-methoxy)phenyl-benzene diazonium. Cl;
2,5-dimethoxy-4-(4'-methyl)phenylthio-benzene diazonium. ½ $ZnCl_4$;
2,5-diethoxy-4-(4'-methyl)phenylthio-benzene diazonium. ½ $ZnCl_4$;
2,5-dibutoxy-4-(4'-methyl)phenylthio-benzene diazonium. $HSO_4$;
2-(acetyl)(methyl)amino-4-(4'-methyl)phenythio-5-methoxy-benzene diazonium. ½ $ZnCl_4$;
2-(ethoxycarbonyl)(methyl)amino-4-(4'-methyl)phenylthio-5-methoxy-benzene diazonium. $HSO_4$; and
2-(ethoxycarbonyl)(methyl)amino-4-ethylthio-5-methoxy-benzene diazonium. $HSO_4$.

Examples of diazonium compounds suited for use in the two component diazotype material according to the invention are:

4-morpholino-2,5-diethoxy-benzene diazonium. ½ $ZnCl_4$;
4-pyrrolidino-3-methyl-benzene diazonium. ½ $ZnCl_4$;
4-(diethyl)amino-3-chloro-benzene diazonium. ½ $ZnCl_4$;
4-(methyl)(cyclohexy)amino-3-chloro-benzene diazonium. ½ $ZnCl_4$; and
4-(diethyl)amino-benzene diazonium. ½ $ZnCl_4$.

Other suitable known diazonium salts may be employed if desired.

The diazonium compound may be in the form of the zinc chloride double salt, the cadmium chloride double salt, the chlorobenzene-sulphonate, the borofluoride, or the like, when used in the material of this invention.

The two component diazotype material according to the invention may contain as the coupling agent any of the coupling agents, or mixtures of coupling agents, well known in the art. Examples of suitable coupling agents are found in the book by Jaromir Kosar, "Light-Sensitive Systems" (John Wiley & Sons, 1965), at pages 215–249.

The light sensitive layer may also contain conventional acid stabilisers to inhibit premature coupling, e.g. citric acid, tartaric acid, sulphosalicyclic acid, p-toluene sulphonic acid or other inorganic, aliphatic or aromatic acids.

In addition, the sensitizing composition or dispersion used to form the light sensitive layer may also optionally contain the various additives conventionally employed in the manufacture of light sensitive diazo layers, including hygroscopic agents, e.g. ethylene glycol, propylene glycol; further stabilising or antioxidizing agents, such as thiourea, which function to retard the development of background coloration on the finished print; metallic salts for intensification of the dyestuffs image, e.g. zinc chloride or nickel sulphate; and wetting agents, e.g. saponin, lauryl sulfonate or the oleic acid amide of N-methyl taurine.

When a polymeric support film is used its surface may be treated in ways known in the art to enhance the adhesion of the subsequently applied layers. For instance, when the support film is a biaxially oriented and heat set film of polyethylene terephthalate it may be treated with a priming agent, or a solution of a priming agent, that has a solvent or swelling action upon the film surface, each as a halogenated phenolic material, e.g. orthochlorophenol, para-chlorophenol or 4-chloro-3-methylphenol, chloral hydrate, or a halogenated acid, e.g. trichloroacetic acid.

The support film may also carry one or more subbing layers which may be applied to develop adhesion between the film surface and a subsequently applied layer, such as a drafting layer and/or the light sensitive diazo. The subbing layer or layers may be formed of any suitable polymeric or copolymeric material that is adherent to the surface of the film. Copolymers of vinylidene chloride with comonomers such as acrylonitrile are useful ingredients for subbing layers, as are homopolymers or copolymers of vinyl halogenoester or vinyl cyanoester with one or more other materials such as $\alpha,\beta$-unsaturated carboxylic acids, acrylamide and methacrylamide and their N-methylol derivatives, vinyl acetate and vinyl alcohol. Other useful subbing layer materials are copolymers of vinyl monochloroacetate with vinyl alcohol, copolymers of vinyl chloride and vinyl acetate which may be partially hydrolyzed, cellulose nitrate, cellulose acetate butyrate and phenol-formaldehyde, urea-formaldehyde or melamine-formaldehyde resins.

In another advantageous embodiment of the invention the diazotype material comprises a light-pervious or translucent support having a subbing layer formed on both sides thereof, with a light sensitive layer according to the invention formed on one of the subbing layers and a drafting layer formed on the other subbing layer, the drafting layer being formed of the same partially hydrolyzed polyvinyl acetate as that employed in the light sensitive layer. The polymeric material forming each of the subbing layers desirably is a mixture of a vinylidene chloride-acrylonitrile copolymer and a melamine-formaldehyde resin which may be methylated.

Each of the subbing layers is also formed with a silica pigment dispersed in the polymeric material in order to give this layer writing and drafting properties and to improve the adhesion between this layer and the subsequently applied outer layer. The silica pigment may be the same as used in the light sensitive layer or may be a conventional silica filler having particles sizes smaller than 20 $\mu$m in size and preferably of the order of about 5 $\mu$m in average size. The pigment of the subbing layers preferably is the same as that of the drafting layer.

The following examples will further illustrate the practice of the invention for the provision of diazotype materials having a layer structure as shown schematically in cross section on the accompanying drawing.

The diazotype material of the drawing (which is not drawn to scale) is composed of a transparent support 1, e.g. a polyethylene terephthalate film, coated on its opposite sides with subbing layers 2(*a*) and 2(*b*) and having a light sensitive layer 3 coated onto subbing layer 2(*a*) and a drafting layer 4 coated onto subbing layer 2(*b*).

EXAMPLE I

A transparent polyethylene terephthalate film was coated on each side with a subbing layer formed from a dispersion containing per 1,000 $m^2$ of surface to be coated:

5,000 g of vinylidene chloride-acrylonitrile copolymer,
3,000 ml of a methylated melamine-formaldehyde resin,
50 g p-toluenesulphonic acid,
3,000 g of a crystalline silica (5 μm), such as sold under the name Min-U-Sil by Pennsylvania Glass Sand Corporation,
29,000 ml acetone, and
2,000 ml methyl cellosolve.

The dispersion was applied by a conventional coating method, e.g. by rod coating. After drying a layer weighing about 3–4 g/m$^2$ resulted.

One of the resultant subbing layers was coated with a light sensitive layer formed from a dispersion containing per 1,000 m$^2$ of surface to be coated:

11,000 g of a 25% by weight solution of a partially hydrolyzed PVAC in methanol, the PVAC being Mowilith 60 having in ethyl acetate at 20° C. a Hoeppler viscosity of 180–240 mPa.s and being about 35% hydrolyzed,
150 g citric acid,
300 g zinc chloride,
200 g sodium salt of naphthalene trisulphonic acid,
450 g 2,5-diethoxy-4-(4'-methyl)phenylthio-benzene diazonium. ½ $ZnCl_4$,
300 g 2-(ethoxycarbonyl)(methyl)amino-4-(4'-methyl)-phenylthio-5-methoxy-benzene diazonium. $HSO_4$,
450 ml Alizarinsol RL (1% solution),
2,000 g Gasil WP2 (amorphous hydrated silica),
700 ml formic acid,
1,500 ml methyl cellosolve,
3,500 ml methanol, and
9,000 ml water.

The light sensitizing dispersion was applied by a conventional coating method, e.g. by rod coating. After drying a light sensitive layer weighing about 6–8 g/m$^2$ resulted.

Finally, the other subbing layer was coated with a drafting layer formed from a dispersion containing per 1,000 m$^2$ of surface to be coated:

11,000 g of a 25% by weight solution of a partially hydrolyzed PVAC in methanol, the PVAC being Mowilith 60 having in ethyl acetate at 20° C. a Hoeppler viscosity of 180–240 mPa.s and being about 35% hydrolyzed,
2,000 g Min-U-Sil (a 5 μm crystalline silica),
450 ml Alizarinisol RL (1% solution),
1,000 g hexamethoxymethyl melamine,
50 g p-toluenesulphonic acid,
1,500 methyl cellosolve,
3,500 ml methanol, and
9,000 ml water.

Again, the dispersion was applied by a conventional method, e.g. by rod coating. After drying a layer weighing about 4–8 g/m$^2$ was obtained.

The diazotype material developed well with a conventional OCé A6-developed solution. The copies show a black image on a clear background having a good transparency for actinic light. The wet-rub resistance of freshly developed copies was good.

If in the formulation for the diazo layer the same amount of a conventional non-hydrated amorphous silica is used, for instance Syloid 244 from W. R. Grace & Co, Baltimore, instead of Gasil WP2, a diazotype material is obtained producing copies of which the completely exposed background areas have a 20% lower transparency.

EXAMPLE II

The procedure of Example I was repeated, with the sole exception that the light sensitive layer was now formed as a two component diazo layer by applying a liquid dispersion of the following composition:

11,000 g of a 25% by weight solution of a partially hydrolyzed PVAC in methanol, the PVAC being Mowilith 60 having in ethyl acetate at 20° C. a Hoeppler viscosity of 180–240 mPa.s and being about 35% hydrolyzed,
275 ml of a solution of 1,000 g of zinc chloride in 1000 ml of water,
630 g of 4-(methyl) (cyclohexyl) amino-3-chloro-benzene diazonium. ½ $ZnCl_4$ salt,
45 g of sodium chloride,
225 g of citric aced,
350 g of N-2'-hydroxyethyl-2,4-dihydroxybenzoic acid amide,
175 g of sulphosalicyclic acid, adn
1,200 g of Gasil WP2 (amorphous hydrated silica).

The two component diazotype material thus obtained was imagewise exposed and developed in a conventional ammonia developing machine. The copy showed a brown image on a clear background. If in the above formulation the same amount of Syloid 244 is used instead of Gasil WP2, the diazotype material obtained produces copies of which the completely exposed background areas show an at least 15% lower transparency.

I claim:

1. Diazotype material comprising a support carrying a light sensitive diazo type layer formed of a dispersion of light sensitive diazonium compound in a polymeric binder consisting essentially of a plurality hydrolyzed polyvinyl acetate having a degree of hydrolysis between 20 and 45%, said dispersion containing amorphous hydrated silica particles having a bound water content of at least 50% by weight.

2. Diazotype material according to claim 1, said polyvinyl acetate being a product of partial hydrolysis of a polyvinyl acetate having in ethyl acetate at 20° C. a Hoeppler viscosity in the range of 25 to 2,000 mPa.s.

3. Diazotype material according to claim 1, said polyvinyl acetate being a product of 30 to 40% hydrolysis of a polyvinyl acetate having in ethyl acetate at 20° C. a Hoeppler viscosity in the range of 100 to 800 mPa.s.

4. Diazotype material according to claim 1, said silica particles having a bound water content of between 60 and 70% by weight.

5. Diazotype material according to claim 3, said silica particles having a bound water content of between 60 and 70% by weight.

6. Diazotype material according to claim 1, the amount of said silica particles being in the range of from 40 to 60% of he combined weight of silica particles and partially hydrolyzed polyvinyl acetate present in said layer.

7. Diazotype material according to claim 3, the amount of said silica particles being in the range of from 40 to 60% of the combined weight of silica particles and partially hydrolyzed polyvinyl acetate present in said layer.

8. Diazotype material according to claim 4, the amount of said silica particles being in the range of from 40 to 60% of the combined weight of silica particles and partially hydrolyzed polyvinyl acetate present in said layer.

9. Diazotype material according to claim 5, the amount of said silica particles being in the range of from 40 to 60% of the combined weight of silica particles and partially hydrolyzed polyvinyl acetate present in said layer.

10. Diazotype material according to claim 1, said support being a light-pervious polymeric film having said light sensitive diazo layer on one side thereof and carrying a light-pervious drafting layer on its other side.

11. Diazotype material according to claim 10, said drafting layer being formed of a binder consisting essentially of a said partially hydrolyzed polyvinyl acetate and having a silica pigment dispersed therein.

12. Diazotype material according to claim 1, said support being a light-pervious polymeric film having on each side thereof a subbing layer formed of polymeric material adherent to the surface of said film, a drafting layer being formed on one said subbing layer and said diazo layer being formed on the other subbing layer, said drafting layer being formed of a dispersion of finely divided pigment in a polymeric binder consisting essentially of a said partially hydrolyzed polyvinyl acetate.

13. Diazotype material according to claim 12, each said subbing layer containing a silica pigment.

14. Diazotype material according to claim 13, the pigment in each said subbing layer and in said drafting layer consisting essentially of crystalline silica particles having sizes smaller than 20 μm and generally of the order of about 5 μm.

15. Diazotype material according to claim 3, said light sensitive layer being a one-component diazo layer containing said diazonium compound in the absence of an azo coupling agent, said support being a light-pervious polymeric film having on each side thereof a subbing layer formed of polymeric material adherent to the surface of said film, a drafting layer being formed on one said subbing layer and said diazo layer being formed on the other subbing layer, said drafting layer being formed of a dispersion of finely divided pigment in a polymeric binder consisting essentially of a said partially hydrolyzed polyvinyl acetate.

16. Diazotype material according to claim 7, said light sensitive layer being a one-component diazo layer containing said diazonium compound in the absence of an azo coupling agent, said support being a light-pervious polymeric film having on each side thereof a subbing layer formed of polymeric material adherent to the surface of said film, a drafting layer being formed on one said subbing layer and said diazo layer being formed on the other subbing layer, said drafting layer being formed of a dispersion of finely divided pigment in a polymeric binder consisting essentially of a said partially hydrolyzed polyvinyl acetate.

17. Diazotype material comprising a light-pervious support film of cellulose acetate or polyethylene terephthalate, coated onto each side of said film a light-pervious subbing layer formed of a dispersion of silica pigment particles having average sizes of the order of about 5 μm in a polymeric binder adherent to the surface of said film;

coated onto one said subbing layer a light-pervious light sensitive diazo layer formed of a dispersion of light sensitive diazonium salt and amorphous hydrated silica particles having a bound water content of between 50 and 70% by weight in a binder consisting essentially of a 20 to 45% hydrolyzed product of a polyvinyl acetate having in ethyl acetate at 20° C. a Hoeppler viscosity in the range of 100 to 800 mPa.s, the amount of said hydrated silica particles being in the range of from 40 to 60% of the combined weight of hydrated silica particles and partially hydrolyzed polyvinyl acetate in said diazo layer; and coated on the other said subbing layer a light-pervious drafting layer formed of a dispersion of silica pigment particles having average sizes of the order of about 5 μm in a polymeric binder consisting essentially of a said 20 to 45% hydrolyzed product of a said polyvinyl acetate.

18. Diazotype material according to claim 17, said polymeric binder of each said subbing layer consisting essentially of a mixture of a vinylidene chloride-acrylonitrile copolymer and a methylated melamine-formladehyde resin.

19. Diazotype material according to claim 17, said light sensitive layer being a one component diazo layer containing a said diazonium salt in the absence of an azo coupling agent, and being developable to form an azo dye by application of an aqueous developing solution thereto.

20. Diazotype material according to claim 17, said light sensitive layer being a two-component diazo layer containing a said diazonium salt in the presence of an azo coupling agent, and being developable to form an azo dye by application of ammonia vapor thereto.

* * * * *